US012385350B2

(12) United States Patent
Seymour et al.

(10) Patent No.: US 12,385,350 B2
(45) Date of Patent: Aug. 12, 2025

(54) RETAINING BACKUP SYSTEM FOR FRAC PLUGS

(71) Applicant: Schlumberger Technology Corporation, Sugar Land, TX (US)

(72) Inventors: Nathan Seymour, Pearland, TX (US); Mitchell Gamble, Calgary (CA); Austin Chen, Rosharon, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 28 days.

(21) Appl. No.: 18/470,485

(22) Filed: Sep. 20, 2023

(65) Prior Publication Data

US 2024/0093568 A1 Mar. 21, 2024

Related U.S. Application Data

(60) Provisional application No. 63/376,452, filed on Sep. 21, 2022.

(51) Int. Cl.
*E21B 33/12* (2006.01)
*E21B 33/129* (2006.01)

(52) U.S. Cl.
CPC ..... *E21B 33/1208* (2013.01); *E21B 33/129* (2013.01)

(58) Field of Classification Search
CPC ... E21B 33/1208; E21B 33/129; E21B 33/128
See application file for complete search history.

(56) References Cited

U.S. PATENT DOCUMENTS

| | | | | |
|---|---|---|---|---|
| 10,435,982 | B2 * | 10/2019 | Shkurti | E21B 33/129 |
| 10,801,300 | B2 * | 10/2020 | Saeed | E21B 33/128 |
| 11,035,197 | B2 * | 6/2021 | Saeed | E21B 33/12 |
| 2017/0198544 | A1 * | 7/2017 | Moore | E21B 33/1293 |

* cited by examiner

*Primary Examiner* — Catherine Loikith
(74) *Attorney, Agent, or Firm* — Jeffrey D. Frantz

(57) ABSTRACT

A backup ring for a frac plug. The backup ring may include a plurality of segments defined by a plurality of slots, where each segment is defined by a sequential pair of the plurality of slots. The backup ring may also include a plurality of buttons, wherein at least one button is disposed on each segment. The backup ring creates a backup anchor for the sealing element and reduces or prevents extrusion of the sealing element.

16 Claims, 3 Drawing Sheets

RETAINING BACKUP SYSTEM FOR FRAC PLUGS

CROSS-REFERENCE TO RELATED APPLICATIONS

Any and all applications for which a foreign or domestic priority claim is identified in the Application Data Sheet as filed with the present application are hereby incorporated by reference under 37 CFR 1.57. The present application claims priority benefit of U.S. Provisional Application No. 63/376,452 filed Sep. 21, 2022, the entirety of which is incorporated by reference herein and should be considered part of this specification.

BACKGROUND

In the field of hydrocarbon production, hydraulic fracturing or "fracing" is a process of stimulating a hydrocarbon producing well by fracturing the surrounding rock with a hydraulically pressurized fluid of water, sand and chemicals. During fracing it is commonly necessary to isolate each zone so as to only provide the pressurized fluid and sand to the desired location within the well. This is due to the potential for the well to be quite long and therefore the pumping and material required to therefore frac the entire well string would be too large.

In a variety of well fracturing applications, a wellbore is initially drilled and cased. the frac plug is then pumped down and actuated to form a seal with the surrounding casing. One common method of splitting the well up into the manageable zones is to provide a plug below the zone to be fractured. Once the casing is perforated, the frac plug is used to prevent fracturing fluid from flowing farther downhole, thus forcing the fracturing fluid out through the perforations and into the surrounding formation. In some applications, multiple frac plugs may be deployed to enable fracturing at different well zones. Each frac plug comprises a sealing element which is deformed into sealing engagement with the surrounding casing. The sealing element may be formed of an elastomeric material or metal material which is deformed in a radially outward direction until forming a permanent seal with the inside surface of the casing. To ensure sealing, the frac plug tends to be formed with relatively precise and expensive components. In addition to the expense, the construction of such a frac plug also can lead to difficulties associated with milling out the frac plug after completion of the fracturing operation.

SUMMARY

According to one or more embodiments of the present disclosure, a backup ring includes a plurality of segments defined by a plurality of slots, wherein each segment is defined by a sequential pair of the plurality of slots, and a plurality of buttons, wherein at least one button is disposed on each segment.

According to one or more embodiments of the present disclosure, a frac plug for use within a cased well includes a mandrel, a sealing element disposed around the mandrel, a backup ring disposed around the mandrel and adjacent to the sealing element, a cone disposed around the mandrel and adjacent to the backup ring, and a slip assembly that, when the frac plug is set within the cased well, travels along the cone and expands radially to allow buttons disposed in slips of the slip assembly to engage the casing of the well. The backup ring includes a plurality of segments defined by a plurality of slots, wherein each segment is defined by a sequential pair of the plurality of slots, and a plurality of buttons, wherein at least one button is disposed on each segment.

According to one or more embodiments of the present disclosure, a method of fracturing a well includes disposing a frac plug within a bore of the well. The method also includes setting the frac plug to engage buttons disposed in slips of a slip assembly of the frac plug with an inner surface of a casing within the well and to engage buttons disposed in segments of a backup ring of the frac plug with the inner surface of the casing to retain the frac plug within the casing.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein.

DETAILED DESCRIPTION

In the following description, numerous details are set forth to provide an understanding of some embodiments of the present disclosure. However, it will be understood by those of ordinary skill in the art that the apparatus and/or method may be practiced without these details and that numerous variations or modifications from the described embodiments may be possible.

In the specification and appended claims: the terms "connect," "connection," "connected," "in connection with," "connecting," "couple," "coupled," "coupled with," and "coupling" are used to mean "in direct connection with" or "in connection with via another element." As used herein, the terms "up" and "down," "upper" and "lower," "upwardly" and "downwardly," "upstream" and "downstream," "uphole" and "downhole," "above" and "below," and other like terms indicating relative positions above or below a given point or element are used in this description to more clearly describe some embodiments of the disclosure.

Figure 1:
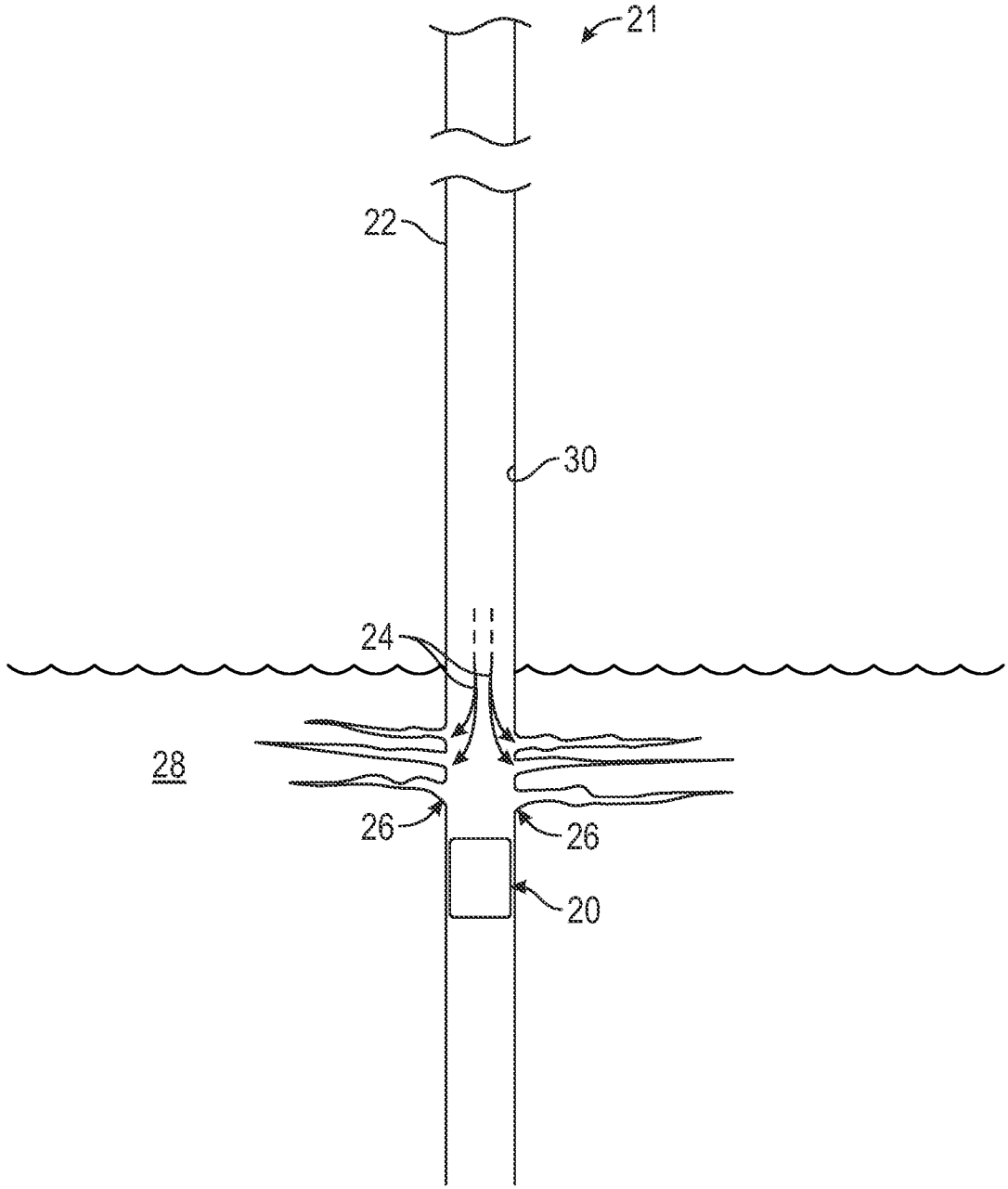
FIG. 1 is a schematic illustration of an example of a downhole tool deployed in a wellbore according to one or more embodiments of the present disclosure.

Referring generally to FIG. 1, an embodiment of a downhole tool 20 is illustrated deployed in a well 21. According to one or more embodiments of the present disclosure, the downhole tool 20 is a frac plug. For example, the frac plug 20 may be deployed in a wellbore 22 to facilitate a fracturing operation. In the example illustrated, the frac plug 20 is deployed in the wellbore 22 to isolate a zone of the wellbore 22 so that fracturing fluid 24 may be directed through perforations 26 and into a surrounding formation 28 uphole of the frac plug 20 for fracturing of the surrounding formation 28. It should be noted that the frac plug 20 according to one or more embodiments of the present disclosure may be used in many types of wellbores, such as deviated, e.g., horizontal, wellbores to facilitate fracturing of desired well zones along the horizontal or otherwise deviated wellbore.

Still referring to FIG. 1, the wellbore 22 may be lined with a casing 30, and each frac plug 20 may be actuated to grip into and seal against the casing 30, thereby sealing or substantially restricting flow of the fracturing fluid 24 downhole of the frac plug 20 in the wellbore 22. As a result, during a fracturing operation, the fracturing fluid 24 is directed through the perforations 26 into the surrounding formation 28 while the frac plug 20 remains anchored to the casing 30. Once the fracturing operation is completed and a given frac plug 20 is no longer of use, the frac plug 20 may be milled and removed from the wellbore 22.

Figure 2:
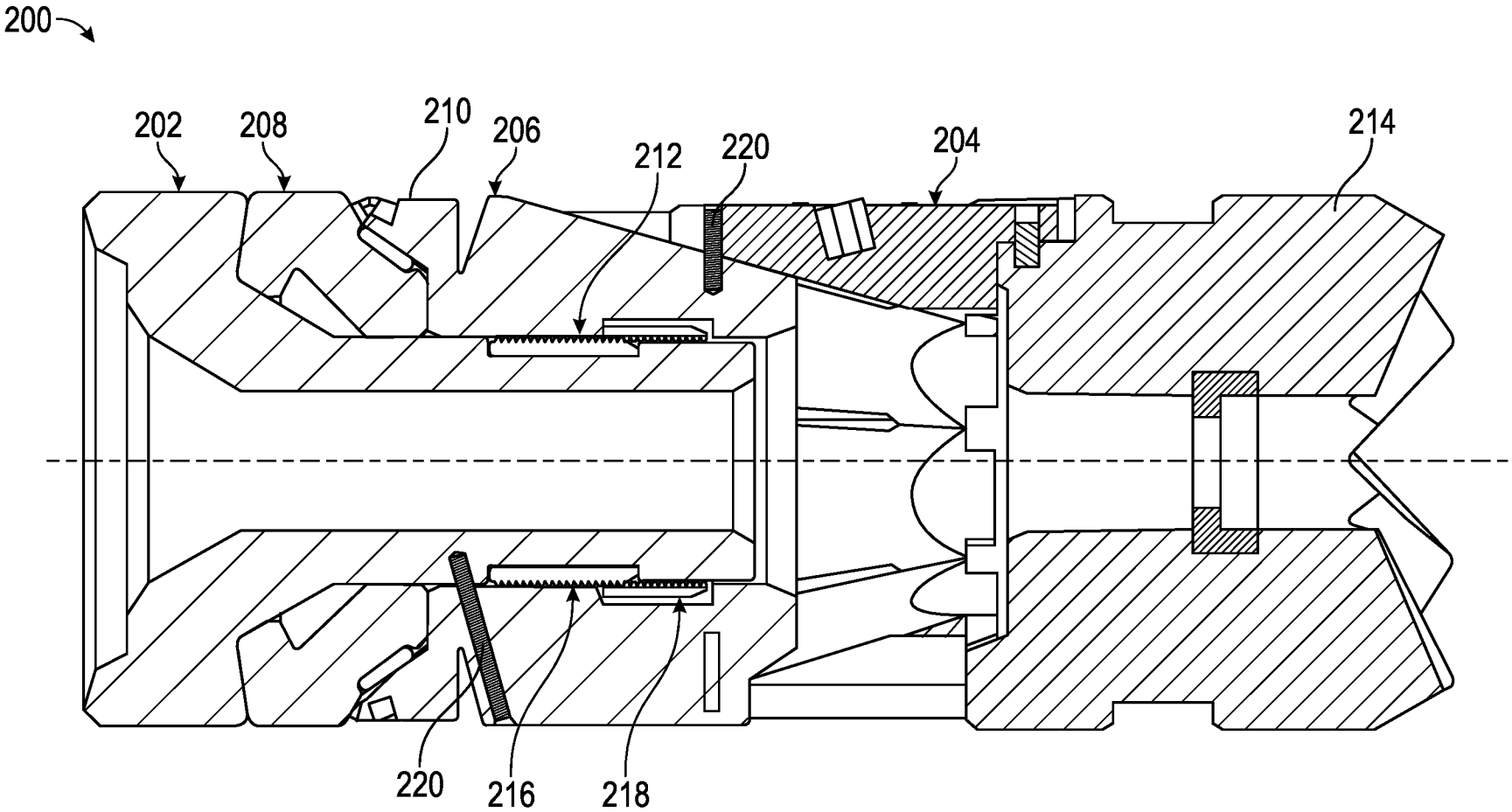
FIG. 2 is a cross-sectional view of a frac plug according to one or more embodiments of the present disclosure.

Referring now to FIG. 2 is a cross-sectional view of a frac plug 200 according to one or more embodiments of the present disclosure is shown. Specifically, FIG. 2 shows the frac plug 200 in an unset position. According to one or more embodiments, the frac plug 200 may include a mandrel 202, a slip assembly 204, a cone 206, a sealing element 208, bottom sub 214 and a backup ring 210 disposed around the mandrel 202. The frac plug 200 is held together in a run-in-hole unset position by shear pins 220. When a set force is applied to the frac plug 200, the shear pins 220 are sheared allowing the various parts of the shear plug 200 to move relative to each other. In one or more embodiments, the backup ring 210 is disposed adjacent the sealing element 208 and the backup ring 210, which may radially expand against an inner wall of the casing 30 and create a circumferential barrier to keep the sealing element 208 from extruding. Additionally, the backup ring 210 may be integrally formed with the cone 206. In other embodiments, the backup ring 210 may be separate from the cone 206. The frac plug 200 also includes an internal locking mechanism 212, such as a lock rings or a ratcheting mechanism. The internal locking mechanism 212 consists of an inner locking ring 216 and an outer locking ring 218. The inner locking ring 216 is positioned in a groove in an outer surface of the mandrel 202. The outer locking ring 218 is positioned in a groove in an inner surface of the cone 206. The inner locking ring 216 and outer locking ring 218 both have a ratchet mechanism that will overlap and help keep the frac plug 200 energized and pressed into the casing 30. The internal locking mechanism 212 keeps the sealing element 208 axially compressed and retains the backup ring 210 and slip assembly 204 against the casing 30 after the frac plug 200 is set within the casing 30, as described in more detail below.

Figure 3:
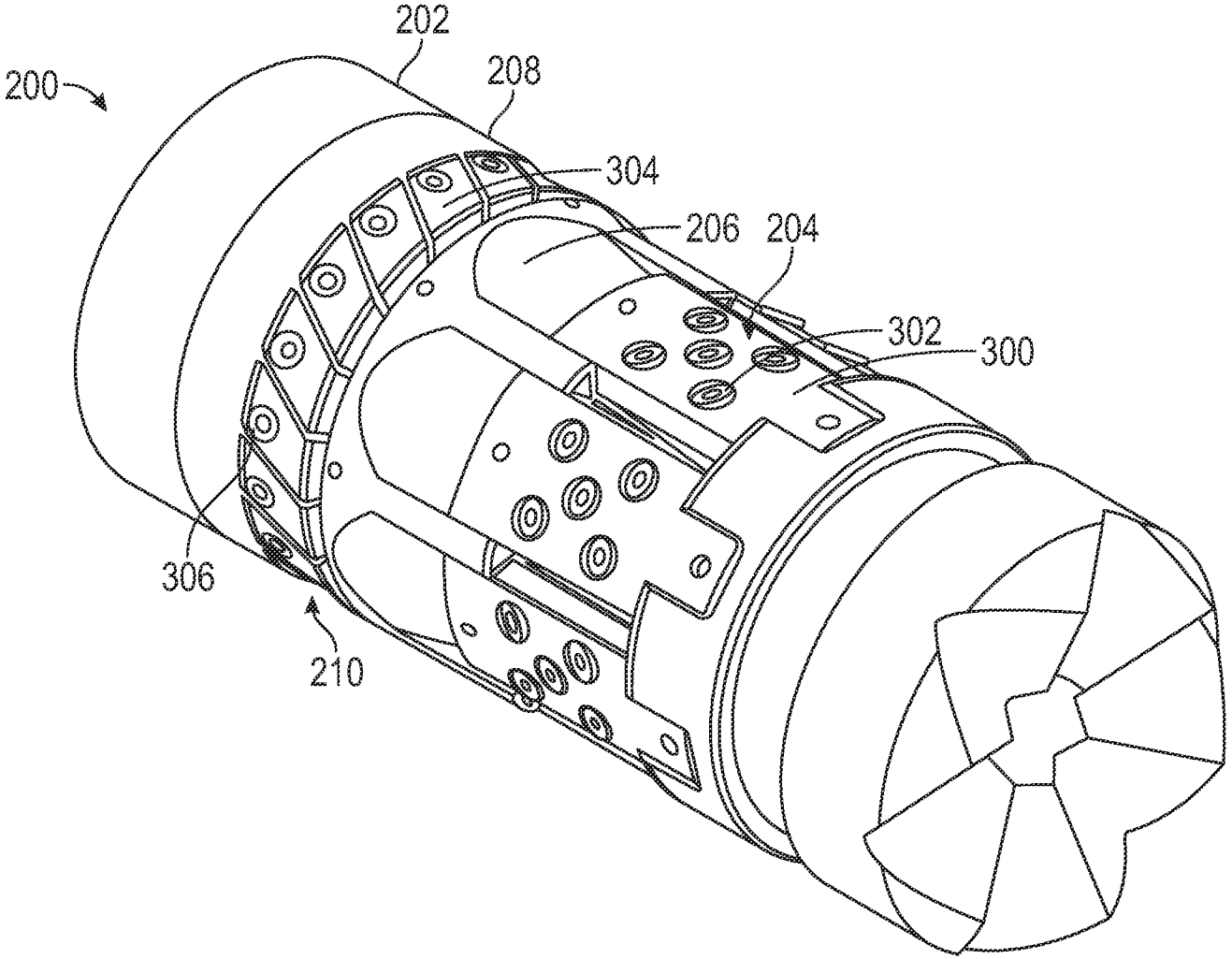
FIG. 3 is an isometric view of the frac plug of FIG. 2.

Turning now to FIG. 3, FIG. 3 is an isometric view of the frac plug 200 of FIG. 2. As shown in FIG. 3, the slip assembly 204 of the frac plug 200 may include a plurality of slips 300. Further, each slip 300 may include one or more buttons 302 disposed in the slip 300. Similarly, the backup ring 210 includes multiple segments 304 that each include at least one button 306 disposed therein. The multiple segments 304 on the backup ring 210 For example, a plurality of slanted slots (not labeled) may be formed circumferentially between the multiple segments 304. The slots may not extend across the entire axial length of the multiple segments 304. The slots will cause the multiple segments 304 to rotate when energized.

When the frac plug 200 is compressed from the run-in-hole unset position to a set position, the slip assembly 204 travels along the cone 206, causing the slip assembly 204 to radially expand. The radial expansion of the slip assembly 204 causes the buttons 302 disposed in the slips 300 to grip and bite into the inner surface of the casing 30. Further, when the frac plug 200 is in the set position, the sealing element 208 is deformed into sealing engagement with the surrounding casing 30. Additionally, the transition from the unset position to the set position, the segments 304 of the backup ring 210 break apart, rotate, and extend radially into the casing to create a backup anchor for the sealing element 208 that reduces or prevents extrusion of the sealing element 208. The buttons 306 on one or more segments 304 also grip and bite into the inner surface of the casing 30. The buttons 306 on the one or more segments 304 prevent uphole movement.

According to one or more embodiments of the present disclosure, the sealing element 208 may be formed of an elastomeric material or metal material, which is deformed in a radially outward direction until forming a permanent seal with the inside surface of the casing 30. Due to the gripping and biting of the buttons 302, 306 and the sealing of the sealing element 208, the frac plug 200 is able to be effectively anchored to the inside surface of the casing 30 when the frac plug 200 is in the set position. The frac plug 200 may remain anchored to the inside surface of the casing 30 during a fracturing operation, and after the fracturing operation, the frac plug 200 may be drilled out, as previously described.

Although a few embodiments of the disclosure have been described in detail above, those of ordinary skill in the art will readily appreciate that many modifications are pos sible without materially departing from the teachings of this disclosure. Accordingly, such modifications are intended to be included within the scope of this disclosure as defined in the claims.

What is claimed is:

1. A backup ring for use with a sealing element, comprising:

a plurality of segments defined by a plurality of slots, wherein each segment is defined by a sequential pair of the plurality of slots; and a plurality of buttons, wherein at least one button is disposed on each segment, wherein the backup ring is configured to break apart, rotate, and extend radially into a casing of a cased well to create a backup anchor for the sealing element.

2. The backup ring of claim 1, wherein the backup ring is disposed around a mandrel of a frac plug and adjacent to the sealing element.

3. The backup ring of claim 2, wherein the backup ring prevents extrusion of the sealing element when radially extended into the casing.

4. The backup ring of claim 2, wherein the least one button disposed on each segment of the backup ring engages with the casing when the frac plug is set.

5. A frac plug for use within a cased well, the frac plug comprising:

a mandrel;

a sealing element disposed around the mandrel;

a backup ring disposed around the mandrel and adjacent to the sealing element, the backup ring comprising:

a plurality of segments defined by a plurality of slots, wherein each segment is defined by a sequential pair of the plurality of slots, and wherein the plurality of segments is configured to break apart, rotate, and extend radially into a casing of the cased well to create a backup anchor for the sealing element; and a plurality of buttons that, when the frac plug is set within the cased well, engage with the casing of the cased well, wherein at least one button is disposed on each segment;

a cone disposed around the mandrel and adjacent to the backup ring;

shear pins to help the frac plug in a run-in-hole unset position; and a slip assembly that, when the frac plug is set within the cased well, travels along the cone and expands radially to allow buttons disposed in slips of the slip assembly to engage the casing of the well.

6. The frac plug of claim 5, wherein the backup ring is integrally formed with the cone.

7. The frac plug of claim 5, further comprises an internal locking mechanism.

8. The frac plug of claim 7, wherein the locking mechanism further comprises an inner locking ring with a ratchet surface and an outer locking ring with a ratchet surface; and wherein the ratchet surface of the inner locking ring engages the ratchet surface of the outer locking ring to lock the frac plug in a set position.

9. The frac plug of claim 5, wherein the plurality of slots does not extend across an entire axial length of the plurality of segments.

10. The frac plug of claim 5, wherein the sealing element is formed of an elastomeric material or a metal material.

11. The frac plug of claim 5, wherein the buttons of the segments and the buttons of the slips grip and bite into an inner surface of the casing.

12. The frac plug of claim 5, wherein the backup ring prevents extrusion of the sealing element when radially extended into the casing.

13. A method of setting a frac plug in a well, the method comprising:

disposing a frac plug within a bore of the well;

setting the frac plug to engage buttons disposed in slips of a slip assembly of the frac plug with an inner surface of a casing within the well and to engage buttons disposed in segments of a backup ring of the frac plug with the inner surface of the casing to retain the frac plug within the casing, wherein when setting the frac plug, the segments of the backup ring break apart, rotate, and extend radially into the casing to create a backup anchor for a sealing element that reduces or prevents extrusion of the sealing element; and performing a fracturing operation.

14. The method of claim 13, further comprising compressing the sealing element disposed around a mandrel of the frac plug creating an engagement with the surrounding casing.

15. The method of claim 13, further comprising locking the frac plug in a set position with an internal locking mechanism.

16. The method of claim 13, wherein the frac plug is drilled out after the fracturing operation.

* * * * *